US006070434A

United States Patent [19]

Traver

[11] Patent Number: 6,070,434

[45] Date of Patent: Jun. 6, 2000

[54] ORNAMENTAL NECKPIECE

[76] Inventor: Robert L. Traver, 15 Ridgewood Rd., Woodbury, Conn. 06798

[21] Appl. No.: 09/290,468

[22] Filed: Apr. 12, 1999

[51] Int. Cl.[7] ..... A44C 13/00

[52] U.S. Cl. ..... 63/1.11; 63/3.1; 63/4; 63/21; 2/129; 2/141.1; 24/900.1

[58] Field of Search ..... 63/1.18, 3, 3.1, 63/4, 21, 24, 1.11; 351/52; 2/129, 137, 145, 141.1; 24/900.1, 299

[56] References Cited

U.S. PATENT DOCUMENTS

| | | | |
|---|---|---|---|
| D. 35,545 | 12/1901 | Schaefer | 111/62 |
| D. 69,012 | 12/1925 | Dalin | 63/3 |
| 128,443 | 6/1872 | White | 63/24 X |
| D. 149,472 | 5/1948 | Chernow | 63/3 X |
| 268,102 | 11/1882 | Horton | 63/21 |
| 272,829 | 2/1883 | Cockshaw | 63/3 X |
| 426,087 | 4/1890 | Wolkow . | |
| 713,565 | 11/1902 | Hart, Jr. | 2/141.1 |
| 1,074,905 | 10/1913 | Smith | 24/40 |
| 1,429,804 | 9/1922 | Tooker . | |
| 1,448,465 | 3/1923 | Sherman | 63/3 |
| 1,683,545 | 9/1928 | Harris . | |
| 1,849,321 | 3/1932 | Tomlinson . | |
| 1,862,444 | 6/1932 | Vickers . | |
| 2,624,050 | 1/1953 | Boller | 2/115 |
| 2,707,285 | 5/1955 | Tino | 2/330 |
| 2,779,523 | 1/1957 | Klimkiewicz | 63/3 X |
| 2,840,286 | 6/1958 | Schermerhorn | 63/4 X |
| 2,886,823 | 5/1959 | Kuhlman | 2/145 |
| 3,722,070 | 3/1973 | Shiner | 29/433 |
| 4,377,078 | 3/1983 | Block | 63/3.1 |
| 4,825,472 | 5/1989 | Garafano | 2/141 A |
| 5,253,366 | 10/1993 | Marlo et al. | 2/145 |
| 5,274,853 | 1/1994 | Millican | 2/141.2 |
| 5,337,457 | 8/1994 | Chennault | 2/145 X |
| 5,692,240 | 12/1997 | Steele | 2/129 |
| 5,794,459 | 8/1998 | Ignatowski | 63/38 |
| 5,896,184 | 4/1999 | Lowe et al. | 63/1.18 X |

*Primary Examiner*—Terry Lee Melius
*Assistant Examiner*—Andrea Chop
*Attorney, Agent, or Firm*—William C. Crutcher

[57] ABSTRACT

An ornamental neckpiece for a shirt with a buttoned collar, which is intended to be worn when the collar is unbuttoned, comprising an ornamental chain or cord having an attachment on one end suitable for attachment to the shirt collar button and an attachment on the other end suitable for attachment to the shirt collar buttonhole, and being of a length greater than the space between the button and buttonhole when the shirt collar is unbuttoned as to hang loosely and serve as a jewelry item.

20 Claims, 2 Drawing Sheets

ORNAMENTAL NECKPIECE

This invention relates to an article of jewelry, and more particularly to an ornamental neckpiece for a shirt with a button collar which is to be worn when the shirt collar is unbuttoned.

Shirts with buttoned collars are designed to be worn either buttoned in a closed position with a tie or similar device, or worn unbuttoned. When the shirt collar is buttoned, the tie knot covers the button and buttonhole so as to provide a neat appearance. When the shirt collar is unbuttoned, however, which is more comfortable, the appearance of the collar may be too casual and lack the decorative aspect provided by a necktie or the like.

Decorative neck pieces are known which are intended to be used with closed collars, as illustrated by U.S. Pat. No. 1,429,804 issued Sep. 19, 1992 to Tooker and U.S. Pat. No. 1,862,444 issued Jun. 7, 1932 to Vickers. These are short decorative devices, which are attached to opposite ends of the collar by spring-loaded fingers and intended to secure the collar in place. Other similar devices are known consisting of elastic members intended to perform a holding function for articles of clothing. U.S. Pat. No. 426,087—Wolkow issued Apr. 22, 1890 shows a decorative elastic member having a loop on one end adapted to cooperate with a button on a coat and a pivoted bar on the other end adapted to cooperate with the buttonhole on the opposite side of the coat. The prior art also discloses decorative chains which hang in a catenary or support pendants, and are intended to be used with articles of clothing, such as illustrated in U.S. Pat. No. 1,683,545—Harris issued Sep. 4, 1928 and U.S. Pat. No. 1,849,321—Tomlinson issued Mar. 15, 1932.

Lastly, the prior art includes a utilitarian device intended to enlarge or expand a tight collar, comprising a button to fit in a collar buttonhole, and an elastic loop to fit over a shirt collar button, and stretch to allow the collar to expand. This is not an ornamental or decorative device and is intended to be concealed by a tie.

It would be desirable to provide an article of jewelry intended to be worn as a fashion item to provide a more finished appearance to a man's or a woman's shirt or blouse when worn open without a tie, necklace or other neck ornament. While such a device would be useful as a fashion item primarily for use on a man's shirt when worn open without a tie, it would be useful in connection with any type of button shirt for a man or woman which is worn open.

Accordingly, one object of the present invention is to provide an improved decorative neckpiece for an open-neck shirt.

Another object of the invention is to provide an improved article of jewelry for use on a buttoned shirt when worn open.

SUMMARY OF THE INVENTION

Briefly stated, the invention comprises an ornamental neckpiece for a shirt of the type having a collar adapted to be secured by a button disposed on one side of the collar and arranged to be held in a button hole on the other side of the collar, the ornamental neckpiece comprising an ornamental non-elastic flexible member arranged to hang freely when supported from opposite ends thereof, a first attachment connected to one end of the flexible member and adapted to cooperate with the button to support one end of the flexible member from one side of the collar, a second attachment connected to the other end of the flexible member and adapted to cooperate with the buttonhole to support the other end of the flexible member from the other side of the collar, the neckpiece being longer than the space between the spaced button and buttonhole when the shirt collar is worn unbuttoned.

The ornamental flexible member may be a length of chain, cord, roll of beads or other jointed or flexible element. The first attachment may comprise a loop, hook, or tab with a hole which will fit over the button. The second attachment may comprise a button, bead, ball or bar which is inserted into the neck buttonhole.

DRAWINGS

The invention will be better understood by reference to the following description, taken in connection with the accompanying drawing, in which:

FIG. 1 is a front elevation view of portions of a shirt with collar and ornamental neckpiece in accordance with the present invention, FIG. 2 is a perspective view of a first embodiment of an ornamental neckpiece, omitting the center portion thereof, which is indicated by phantom lines, FIG. 3 is a perspective view of yet another embodiment similar to the preceding view of FIG. 2, FIG. 4 is a perspective view of another embodiment similar to the preceding views, FIG. 5 is a perspective view of yet another embodiment of the invention, similar to the preceding views, and FIG. 6 is a prospective view of yet another embodiment of the invention similar to the preceding views.

DETAILED DESCRIPTION OF THE INVENTION

Figure 1:
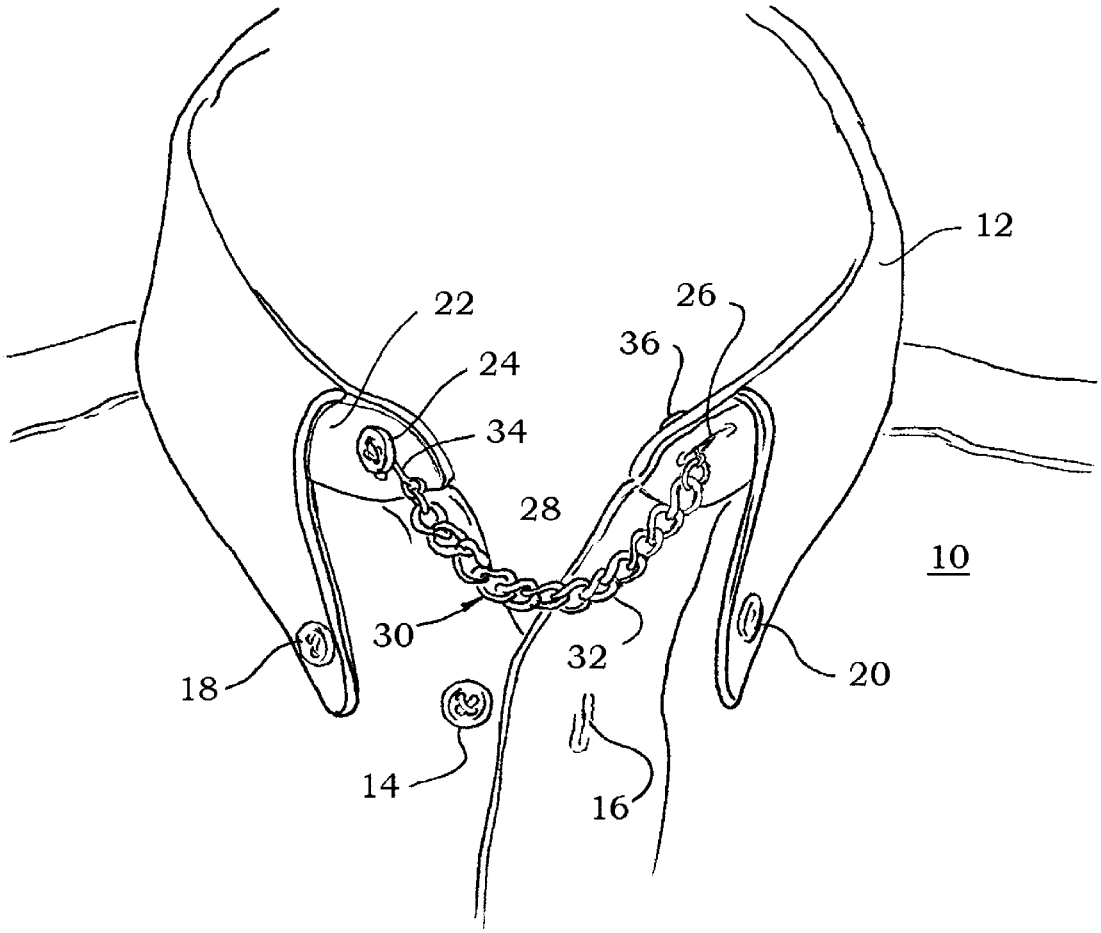

Referring to FIG. 1 of the drawing, a partial view is shown of a shirt 10 having a collar 12. Shirt 10 may be of any type, size or color and is intended to include both men's and women's dress shirts and sport shirts. Shirt 10 is fitted with a conventional set of buttons and buttonholes down the front, such as button 14 and buttonhole 16, and in the case shown, collar 12 is further provided with collar buttons 18, 20 to hold the free ends of the collar in place. Collar 12 includes an inner neckband 22 having a button 24 adapted to insert through a buttonhole 26 on the other end of neckband 22 to hold collar 12 completely closed when the shirt collar is buttoned. As shown in FIG. 1, however, shirt 10 is unbuttoned so that button 24 and buttonhole 26 are spaced from one another. This leaves a somewhat casual gap or substantially V-shaped opening 28 at the neck which the present invention seeks to improve or neaten for semi-casual wear.

In accordance with the present invention, an ornamental neckpiece 30 having a length longer than the unbuttoned spacing between button 24 and buttonhole 26 is attached to opposite ends of neckband 22 so as to hang freely and at least partially conceal and follow the neck opening 28. The ornamental neckpiece includes an ornamental non-elastic flexible member 32 having a first attachment 34 connected to one end thereof and a second attachment 36 connected to the other end thereof. The first attachment 34 is adapted to cooperate with button 24 to support one end of the flexible member 32. Accordingly, first attachment 34 may be a loop, hook, tab (with a buttonhole) or other similar attachment designed to hook over button 24. The second attachment 36 is adapted to cooperate with the buttonhole 26, and therefore may take a variety of forms such as a button, bead, ball or center-connected pivotable bar which may be inserted through the buttonhole 26.

The ornamental non-elastic flexible member 32 may also take a variety of forms. In its preferred form, member 32 is a chain consisting of decorative links, which will hang loosely in the shape of a catenary as illustrated in FIG. 1. However, it may alternately be an equivalent non-elastic flexible member such as a cord, roll of beads or other jointed or flexible member intended to hang loosely and partially cover and follow the V-shaped neck opening of the unbuttoned shirt collar.

Figure 2:
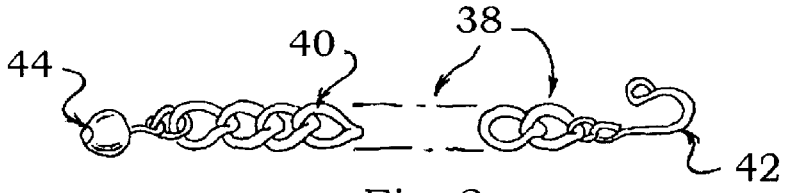

Referring to FIGS. 2 through 6, a number of modifications of the invention are illustrated. In FIG. 2, an ornamental metallic neckpiece shown generally at 38, comprises a twisted loop chain 40 as the flexible member, a wire hook 42 as a first attachment, and a metal bead 44 as a second attachment. The FIG. 2 metallic neckpiece may be made from various metals such as gold, copper, brass, aluminum, silver or titanium.

Figure 3:
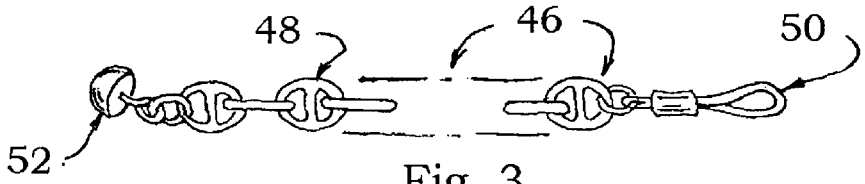

In FIG. 3, a modified form of the invention shows a neckpiece 46 with an anchor style chain 48 as the flexible member, a soft plastic loop 50 as a first attachment and a half bead 52 as a second attachment. The material may be metal, plastic or a combination of these materials.

Figure 4:
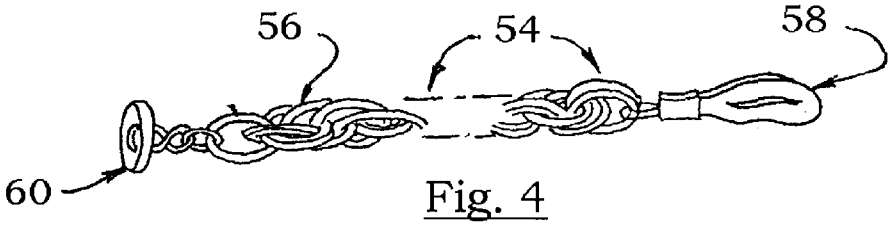

FIG. 4 illustrates a neckpiece 54 having a multiple loop chain 56 as the flexible element, a buttonhole tab 58 of leather, plastic or fabric as a first attachment, and a button 60 of similar material as a second attachment.

Figure 5:
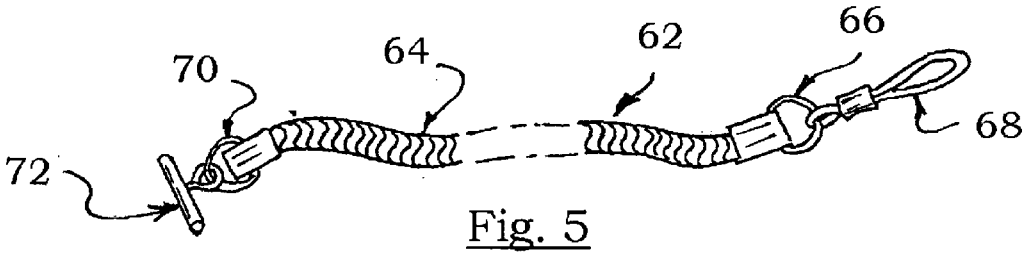

In FIG. 5, a neckpiece shown at 62 comprises a flat pressed metal chain 64 as a flexible member. The first attachment comprises a ring 66 and a connecting loop 68 providing a pivotable attachment. The second attachment comprises a ring 70 pivotably attached to the center of a bar 72 to provide a pivotable connection at the buttonhole.

Figure 6:
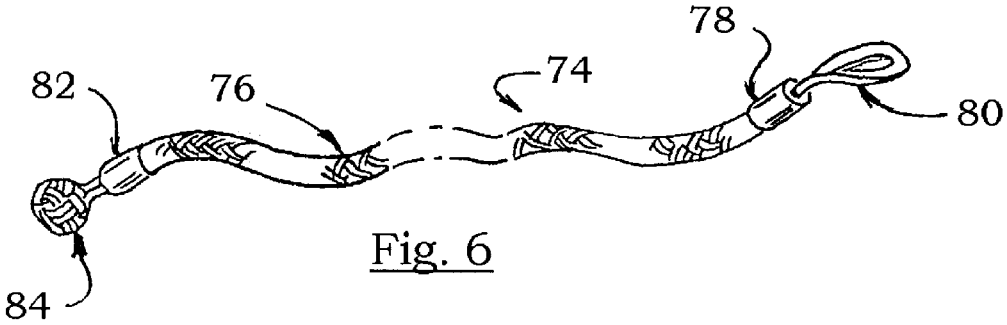

Lastly, FIG. 6 illustrates a neckpiece 74 made entirely of fabric, cord, leather or similar material. The flexible member is a braided cord 76. A first attachment comprises a grommet 78 holding a soft loop 80. The second attachment comprises a grommet 82 holding a knot (monkey's fist) 84.

Many other variations of the flexible member and attachments are possible, those shown in FIGS. 2–6 being only illustrative of the inventive concept. The word "shirt" is not intended to be limiting, but includes any type of shirt or blouse for a man or woman, which has a button collar.

The present invention provides a new look for unbuttoned shirt collars converting them from a too-casual appearance to a neat appearance for semi-casual wear.

While there has been described what is considered to be the preferred embodiment of the invention and several modifications thereof, it is desired to secure in the appended claims all such modifications as fall within the true spirit and scope of the invention.

What is claimed is:

1. The combination of an ornamental neckpiece and a shirt of the type having a collar adapted to be secured by a button disposed on one side of the collar, said button arranged to be held in a buttonhole on the other side of the collar, said neckpiece being adapted to be worn when the shirt collar is unbuttoned so that said button and buttonhole are spaced apart from one another, the ornamental neckpiece comprising:

an ornamental non-elastic flexible member arranged to hang freely when supported from opposite ends thereof, a first attachment connected to one end of said flexible member and adapted to cooperate with said button to support one end of said flexible member from said one side of the collar, a second attachment connected to the other end of said flexible member and adapted to cooperate with said buttonhole to support the other end of said flexible member from said other side of the collar, said neckpiece being longer than the space between the spaced button and buttonhole when the shirt collar is worn unbuttoned, such that the flexible member, the first attachment and the second attachment act as an ornamental neckpiece for a shirt with an unbuttoned collar.

2. The combination according to claim 1, wherein the flexible member comprises a plurality of links forming a chain which will hang freely in a catenary between the button and the buttonhole.

3. The combination according to claim 1, wherein the flexible member comprises a pressed metal chain.

4. The combination according to claim 1, wherein the flexible member comprises a braided cord.

5. The combination according to claim 1, wherein the first attachment comprises a hook.

6. The combination according to claim 1, wherein the first attachment comprises a loop.

7. The combination according to claim 1, wherein the first attachment comprises a tab having a buttonhole therein.

8. The combination according to claim 1, wherein the second attachment comprises a button.

9. The combination according to claim 1, wherein the second attachment comprises a bead.

10. The combination according to claim 1, wherein the second attachment comprises a bar, and a ring pivotably connected to the center of the bar, the ring being connected to the flexible member.

11. The combination of an ornamental neckpiece and a shirt of the type having a collar adapted to be secured by a button disposed on one side of the collar, said button arranged to be held in a buttonhole on the other side of the collar, said neckpiece being adapted to be worn when the shirt collar is unbuttoned so that said button and buttonhole are spaced apart from one another such that said shirt defines a substantially V-shaped neck opening, the ornamental neckpiece comprising:

an ornamental non-elastic flexible member arranged to hang freely when supported from opposite ends thereof, a first attachment connected to one end of said flexible member and adapted to cooperate with said button to support one end of said flexible member from said one side of the collar, a second attachment connected to the other end of said flexible member and adapted to cooperate with said buttonhole to support the other end of said flexible member from said other side of the collar, said neckpiece being longer than the space between the spaced button and buttonhole when the shirt collar is worn unbuttoned, and arranged to hang freely and at least partially conceal and follow the V-shaped neck opening, such that the flexible member, first attachment and second attachment act as an ornamental neckpiece for a shirt with an unbuttoned collar.

12. The combination according to claim 11, wherein the flexible member comprises a plurality of links forming a chain which will hang freely in a catenary between the button and the buttonhole, and substantially follow the shape of the V-shaped neck opening.

13. The combination according to claim 11, wherein the flexible member comprises a pressed metal chain.

14. The combination according to claim 11, wherein the flexible member comprises a braided cord.

15. The combination according to claim 11, wherein the first attachment comprises a hook.

16. The combination according to claim 11, wherein the first attachment comprises a loop.

17. The combination according to claim 11, wherein the first attachment comprises a tab having a buttonhole therein.

18. The combination according to claim 11, wherein the second attachment comprises a button.

19. The combination according to claim 11, wherein the second attachment comprises a bead.

20. The combination according to claim 11, wherein the second attachment comprises a bar, and a ring pivotably connected to the center of the bar, the ring being connected to the flexible member.

* * * * *